US008347643B2

(12) United States Patent
Taras et al.

(10) Patent No.: US 8,347,643 B2
(45) Date of Patent: Jan. 8, 2013

(54) INDOOR AIR QUALITY IMPROVEMENT BY RE-EVAPORATION CONTROL

(75) Inventors: Michael F. Taras, Fayetteville, NY (US); Alexander Lifson, Manlius, NY (US)

(73) Assignee: Carrier Corporation, Farmington, CT (US)

( * ) Notice: Subject to any disclaimer, the term of this patent is extended or adjusted under 35 U.S.C. 154(b) by 1210 days.

(21) Appl. No.: 12/161,073

(22) PCT Filed: May 1, 2006

(86) PCT No.: PCT/US2006/016494

§ 371 (c)(1),
(2), (4) Date: Jul. 16, 2008

(87) PCT Pub. No.: WO2007/130020

PCT Pub. Date: Nov. 15, 2007

(65) Prior Publication Data

US 2009/0223233 A1 Sep. 10, 2009

(51) Int. Cl.
*F25D 17/00* (2006.01)
*F25D 21/00* (2006.01)

(52) U.S. Cl. ..... 62/150; 62/186; 62/272

(58) Field of Classification Search ..... 62/89, 93, 62/150, 180, 186, 272, 278
See application file for complete search history.

(56) References Cited

U.S. PATENT DOCUMENTS

| | | | | |
|---|---|---|---|---|
| 2,884,764 | A * | 5/1959 | Siggelin Gert K A | 62/81 |
| 4,178,767 | A | 12/1979 | Shaw | |
| 4,319,463 | A | 3/1982 | Ljung | |
| 4,459,816 | A | 7/1984 | Lung et al. | |
| 4,517,810 | A | 5/1985 | Foley | |
| 4,771,611 | A | 9/1988 | McNab | |
| 5,284,025 | A * | 2/1994 | Kajitani et al. | 62/160 |

FOREIGN PATENT DOCUMENTS

| | | | |
|---|---|---|---|
| DE | 2721521 | A1 | 11/1978 |
| DE | 3142621 | A1 | 7/1982 |
| EP | 330230 | A1 | 8/1989 |
| GB | 813310 | A | 5/1959 |
| GB | 1368872 | A1 | 10/1974 |
| GB | 2016669 | A | 9/1979 |

OTHER PUBLICATIONS

International Preliminary Report on Patentability dated Nov. 13, 2008.
European Search Report dated Jun. 19, 2012.

* cited by examiner

*Primary Examiner* — Marc Norman
(74) *Attorney, Agent, or Firm* — Carlson, Gaskey & Olds, PC

(57) ABSTRACT

Various control methods are disclosed for removing moisture from the external surfaces of an evaporator in a refrigerant system to avoid moisture entering a conditioned space. In one embodiment, the evaporator fan is driven in a reverse direction, and the air is guided to the outdoor environment. In other embodiments, a supplemental exhaust fan is utilized in conjunction with the evaporator fan. Also, a reheat circuit, hot gas bypass circuit, or specific features of a heat pump unit may be utilized to more efficiently perform the moisture removal.

34 Claims, 1 Drawing Sheet

INDOOR AIR QUALITY IMPROVEMENT BY RE-EVAPORATION CONTROL

BACKGROUND OF THE INVENTION

This application relates to the control of a refrigerant system, and in particular, to the control of indoor fan operation to prevent moisture being re-evaporated from evaporator external surfaces and then being delivered by indoor airflow into a conditioned environment, when a refrigerant compressor is shut down or during system startup.

Refrigerant systems are utilized to condition the air being delivered into an indoor environment. As an example, an air conditioning system or a heat pump is utilized to cool and dehumidify or heat air being delivered into the environment to be conditioned.

In recent years, significant attention has been paid to indoor air quality issues. In particular, precise control of the indoor relative humidity within the comfort zone has been the subject of an increased scrutiny. In part, this desired humidity control is attributed to prevention of mold, bacteria and fungus formation and growth.

As known, refrigerant systems operate at part-load conditions for most of their design life. Thus, the system operates in a start-stop mode quite frequently to satisfy the demanded sensible and latent capacity requirements, when all other means of system unloading are already exhausted. When the system is operating in a cooling mode, an evaporator that cools and dehumidifies the air being delivered into the indoor environment has cold external surfaces. Moisture forms on the cold external surfaces of the evaporator heat exchanger, while the cooled and dehumidified air flows through the heat exchanger and into the conditioned space. This moisture is removed from the air stream and continuously drained into a drain pan. When the system is shut down, there is often a significant amount of moisture accumulated on the evaporator external surfaces. As the evaporator is gradually warming up, this moisture re-evaporates and is re-introduced into the indoor airstream and consequently into the conditioned environment, since in many application cases, the indoor fan has to operate continuously to comply with legislation and regulation requirements.

Even with the indoor fan shut down simultaneously with other system components, such as a compressor, at system startup, a burst of moist air will often be supplied to the indoor environment causing undesired high humidity fluctuations and consequent occupant discomfort. Additionally, this moisture accumulated on the evaporator external surfaces will promote mold, bacteria and fungus formation and growth. It has become an industry practice to treat external evaporator surfaces with anti-microbial compounds, or employ UV lights to prevent growth of microorganisms. These measures are associated with design complexities and additional costs.

Thus, it would be desirable to provide a solution to the problems mentioned above that does not have the drawbacks of the prior art.

SUMMARY OF THE INVENTION

In a disclosed embodiment of this invention, a motor for driving the fan that blows air over the evaporator has a rotation direction reversal feature. Many of three-phase motors are already capable of phase reversal (when the phases are reversed the motor turns in the opposite direction). At a compressor shutdown, the fan is run in reverse for a short period of time, and air flows over the evaporator in an opposite direction. As the moisture is driven off the evaporator external surfaces, this moisture-loaded air is preferably disposed into the outdoor environment. In one embodiment, an airside economizer controlling the appropriate percentages of air mixture from a return duct and from an outdoor environment closes off the flow from the return duct. All of the air that removes the moisture from the gradually warming evaporator is thus delivered to the outside environment. Heat generated by the indoor fan assists in faster moisture re-evaporation and removal from external evaporator surfaces.

In a second embodiment, a supplemental exhaust fan, which in many cases is already incorporated into the system design, assists the main indoor fan in driving air over the evaporator coil in the reverse direction, while fresh air intake may be closed. It has to be noted that, in this embodiment, the return duct may be blocked by a damper and the indoor fan may be shut down completely. In the latter case, the indoor fan does not need to be equipped with the rotation direction reversal feature.

In yet another embodiment, a system equipped with a variable volume temperature (VVT) feature, and having a bypass duct, may utilize the main indoor fan and the exhaust fan to flow air over the evaporator in forward direction to remove moisture. The air would then flow through the bypass duct and then to the outdoor environment. In this embodiment, the air may be repeatedly recycled through the evaporator for a short period of time by the main indoor fan and, when a majority of moisture is removed from the evaporator and accumulated in the re-circulating air, the exhaust fan is turned on for a brief period of time to dump this moist air to the outdoor environment. In this embodiment, the main indoor fan does not have to be equipped with the rotation direction reversal feature as well.

In yet another embodiment, the refrigerant system has a reheat circuit, which is selectively run for a short period of time before the shutdown. In this case, not only indoor fan heat but also the heat from the reheat coil can be utilized to promote faster moisture re-evaporation and removal from the evaporator external surfaces. Analogously, if the refrigerant system is a heat pump, it can be run in a heating mode for a short period of time during the moisture removal process described above. Further, a hot gas by-pass circuit, as known in the industry, can be employed to bypass high pressure refrigerant from the compressor discharge region into the evaporator inlet. In this case, the hot gas bypass circuit can be utilized to assist in moisture re-evaporation and removal by providing additional preheating.

In all embodiments, the moisture removal process can be terminated by a timer or by a sensor such as a humidity sensor, a dew point sensor, a sensor measuring pressure drop across the evaporator, an evaporator surface temperature sensor, an air temperature sensor or an enthalpy sensor. In all cases, the system resumes normal operation after moisture removal is completed, either in an active cooling mode or in air circulation mode.

These and other features of the present invention can be best understood from the following specification and drawings, the following of which is a brief description.

DETAILED DESCRIPTION OF THE PREFERRED EMBODIMENTS

Figure 1:
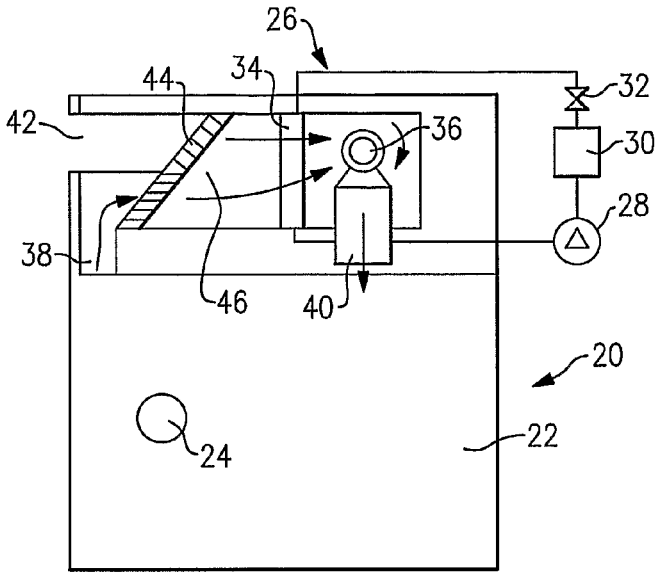
FIG. 1 is a schematic view of the system incorporating the present invention.

A refrigerant system 20 is illustrated in FIG. 1, and serves to provide conditioned air to an environment 22, such as a building. A thermostat 24 within the building allows a user to demand a particular temperature level as known. A control for the refrigerant system 20 thus operates the refrigerant system to achieve the demanded conditions. A closed-loop refrigerant circuit 26 includes a compressor 28 compressing refrigerant and delivering it to an outdoor heat exchanger or condenser 30. From the condenser, the refrigerant passes through an expansion device 32, and then to an indoor heat exchanger or evaporator 34. An indoor fan 36 is associated with the evaporator 34, and drives air over the evaporator 34. As is known, a return duct 38 serves as a conduit for air delivered by the fan 36 from the indoor space 22, and over the evaporator 34 to be conditioned. This air is then delivered to a supply duct 40 to be returned into the conditioned space 22. An airside economizer 44 allows appropriate mixture amounts of outside air from an outdoor opening 42 and re-circulated indoor air from the return duct 38 to be delivered over the evaporator 34. As is known, the economizer 44 is also controlled by the control for the refrigerant system 26 to comply with specified requirements.

As mentioned above, when the cooling demands within the conditioned space 22 are met and all available means of system capacity unloading are exhausted, the refrigerant system operates in a start-stop mode. During shutdown periods, moisture accumulated on the evaporator 34 external surfaces re-evaporates into the airstream and makes its way into the conditioned space, which, as mentioned above, is undesirable.

Figure 2:
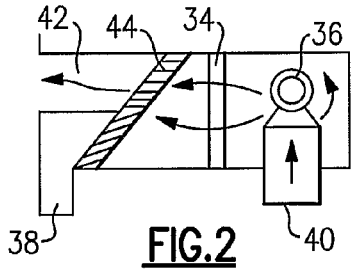
FIG. 2 shows the control operation of the present invention.

One embodiment of the present invention is illustrated in FIG. 2. As shown in FIG. 2, the airside economizer 44 is moved to a position where the airflow through the return duct 38 is blocked and airflow to the outdoor opening 42 is opened. The motor for the fan 36 is a reversible fan motor. For a short period of time, the motor is driven in the reverse direction to the flow of FIG. 1, and air is pulled through the supply duct 40 and over the evaporator 34. This air removes moisture from the evaporator 34 external surfaces and is disposed into an outdoor environment through the outdoor opening 42. The operation in this manner removes the moisture at the refrigerant system compressor shutdowns. Heat generated by the indoor fan assists in faster moisture re-evaporation and removal from external evaporator surfaces. Preferably, such a step is taken soon after the shutdown, in case of continuous air circulation requirement, or before the next startup. This operation should continue for as long as certain criteria for the moisture removal are satisfied. Such criteria for the moisture removal process termination can be associated with a timer or a sensor such as a humidity sensor, a dew point sensor, a sensor measuring pressure drop across the evaporator, an evaporator surface temperature sensor, an air temperature sensor or an enthalpy sensor. The system resumes normal operation after moisture removal is completed, either in an active cooling mode (when a call is issued by a thermostat) or in an air circulation mode.

Figure 3:
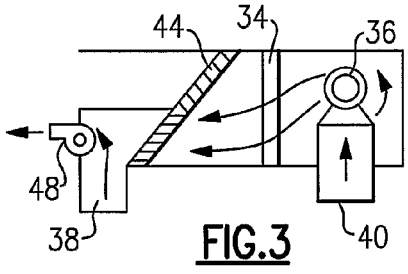
FIG. 3 shows another embodiment.

FIG. 3 shows another embodiment, wherein a supplemental exhaust fan 48 associated with the return duct 38, and in many cases already incorporated into the system design, assists the main indoor fan 36 in driving air over the evaporator in the reverse direction, while the fresh air intake may be closed. Further, if desired, the return duct 38 may be blocked by a damper, and the main indoor fan 36 may be shut down completely. In the latter case, the main indoor fan 36 does not need to be equipped with the rotation direction reversal feature.

Figure 4:
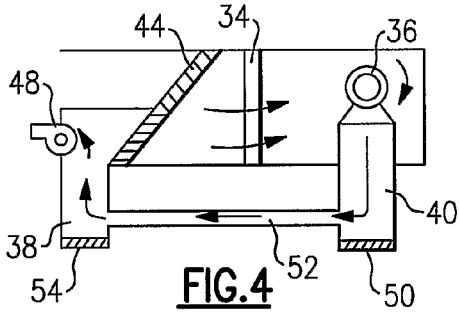
FIG. 4 shows yet another embodiment.

FIG. 4 shows another embodiment wherein the refrigerant system 20 is equipped with a variable volume temperature (VVT) feature and there is a bypass duct 52 between the return duct 38 and the supply duct 40. A damper 50 associated with the supply duct 40 is closed and a damper 54 associated with the return duct 38 is closed as well. The main indoor fan 36 is operated in the conventional forward, FIG. 1 direction and does not need to be reversible. When operated, the supplemental exhaust fan 48 receives the airflow from the bypass duct 52, and delivers that air to the outdoor environment. The main indoor fan 36, operating in a forward direction, drives air over the evaporator 34 external surfaces to remove the accumulated moisture. In this embodiment, the air is repeatedly recycled through the evaporator for a short period of time by the main indoor fan 36 and, when a majority of moisture is removed from the evaporator 34 and accumulated in the re-circulating air, the exhaust fan is turned on, for a brief period of time, to dump this moist air to the outdoor environment. During such communication with the outdoor environment, the main indoor fan 36 may not need to be operating.

Figure 5:
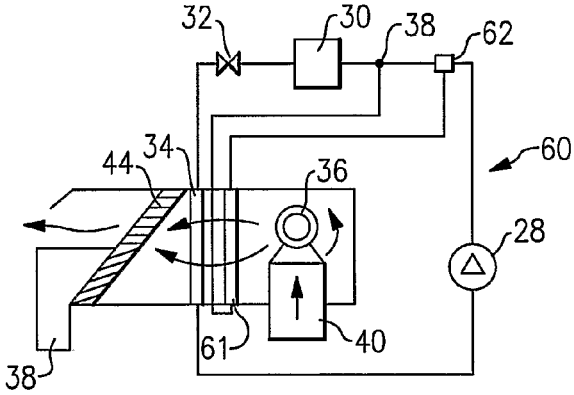
FIG. 5 shows yet another embodiment.

FIG. 5 shows another embodiment 60. Embodiment 60 is similar to the FIG. 2 embodiment, however, a reheat circuit is incorporated in the refrigerant system design. As known, for example, a three-way valve 62 would selectively bypass refrigerant to a reheat coil 61, and return the refrigerant to a point 64 in the main refrigerant circuit. Reheat circuits can tap and return at least a portion of refrigerant to any number of locations within a main refrigerant circuit, and the disclosed locations are merely shown as one example. As known, reheat circuits typically serve to reheat the indoor air downstream of the evaporator (where the air was cooled and dehumidified), in case there is a dehumidification demand (humidistat call) and no significant cooling demand (no thermostat call) in the conditioned space. However, in this invention, the reheat coil 61 serves to further facilitate moisture removal process from external surfaces of the evaporator 34. In the embodiment 60, before the refrigerant compressor is shutdown, the refrigerant system is operated in the reheat mode, for a short period of time, to allow the reheat coil to warm up to its conventional operating temperature. When the refrigerant compressor 28 is shutdown and the indoor fan 36 is operated in reverse, not only the indoor fan heat but also the heat from the reheat coil 61 is utilized to warm up air flowing over the evaporator 34 to promote faster moisture re-evaporation and removal.

Analogously, if the refrigerant system is a heat pump, it can be run in a heating mode, for a short period of time, during moisture removal process to allow the indoor heat exchanger (serving as a condenser in the heating mode of operation) to warm up and facilitate the moisture removal process during indoor airflow reversal, as described above. It has to be noted that the refrigerant system can be operated in a heating mode, for a short period of time, prior to the refrigerant compressor shutdown with the indoor fan 36 turned off. This allows the indoor heat exchanger to warm up faster. When the desired temperature is reached, the indoor fan is operated in reverse, as described above, during the moisture removal process. In the same manner, hot gas bypass to the evaporator inlet can be utilized to assist in moisture re-evaporation and removal.

It is understood that although single-circuit configurations have been disclosed, the benefits of the invention are applicable to multi-circuit system arrangements.

Although preferred embodiments of this invention have been disclosed, a worker of ordinary skill in this art would recognize that certain modifications would come within the scope of this invention. For that reason, the following claims should be studied to determine the true scope and content of this invention.

We claim:

1. A refrigerant system comprising:

a compressor for compressing refrigerant and delivering the refrigerant to a condenser, refrigerant passing from said condenser to an expansion device, and then to an evaporator;

a fan for flowing air over the evaporator; and an air duct system for delivering air over the evaporator, and into a space to be conditioned; and a control being operable to selectively operate the refrigerant system to move air over the evaporator, and to deliver that air to an outside environment to remove moisture from the evaporator.

2. The refrigerant system as set forth in claim 1, wherein said fan has a reversible feature, and said control is operable to operate said fan in a first direction to move air over the evaporator and then be delivered into a space to be conditioned, and is operable to operate said fan in a reverse, second direction, to move the air over the evaporator and to the outside environment.

3. The refrigerant system as set forth in claim 2, wherein said reversible feature is selected from a group consisting of a motor, a switch and a contactor.

4. The refrigerant system as set forth in claim 1, wherein an airside economizer device controls the mixture of air being delivered to the evaporator between outside air and indoor return air.

5. The refrigerant system as set forth in claim 4, wherein said airside economizer is operated to block the flow of air back to indoor return duct from said fan when said fan is being operated in said second direction.

6. The refrigerant system as set forth in claim 4, wherein return duct is at least partially blocked during the operation of said motor in said second direction.

7. The refrigerant system as set forth in claim 2, wherein a reheat circuit is incorporated into the refrigerant system, the reheat circuit having a heat exchanger positioned between said fan and said evaporator, and said reheat circuit serving to heat the air being delivered over the evaporator prior to that air reaching the evaporator when the fan is driven in the second direction.

8. The refrigerant system as set forth in claim 2, wherein said refrigerant system is a heat pump, and said refrigerant system is operated in a heating mode to heat the air being delivered over the evaporator when the fan is driven in the second direction.

9. The refrigerant system as set forth in claim 1, wherein said refrigerant system is a heat pump, and said refrigerant system is operated in a heating mode with the fan shut down for a short period of time prior to the fan being driven in the second direction.

10. The refrigerant system as set forth in claim 1, wherein a hot gas bypass to the evaporator inlet is incorporated into the refrigerant system, and said hot gas bypass serving to heat the evaporator when the fan is driven in the second direction.

11. The refrigerant system as set forth in claim 1, wherein during moisture removal process said fan initially re-circulates air from evaporator to a supply duct, through a bypass duct, to a return duct and back through the evaporator, and then disposes this air to the outdoor environment, and a supply duct being closed to the environment to be conditioned during this operation.

12. The refrigerant system as set forth in claim 1, wherein during moisture removal process said fan circulates air from the evaporator to a supply duct, through a bypass duct, to a return duct, and then disposes this air to the outdoor environment, and a supply duct being closed to the environment to be conditioned during this operation.

13. The refrigerant system as set forth in claim 1, wherein an exhaust fan assists in moving air to said outside environment.

14. The refrigerant system as set forth in claim 1, wherein a moisture removal operation occurs after said refrigerant system is shut down.

15. The refrigerant system as set forth in claim 14, wherein moisture is removed just prior to the refrigerant system being started.

16. The refrigerant system as set forth in claim 1, wherein said control is selectively operating based on information obtained from a timer or a sensor.

17. The refrigerant system as set forth in claim 16, wherein said at least one sensor is selected from a group of a humidity sensor, a dew point sensor, a pressure sensor, a temperature sensor, and an enthalpy sensor.

18. A method of operating a refrigerant system including the steps of:

(1) providing a compressor for compressing refrigerant and delivering the refrigerant to a condenser, refrigerant passing from said condenser to an expansion device, and then to an evaporator;

(2) providing a fan for flowing air over the evaporator; and (3) delivering air through an air duct system over the evaporator, and into a space to be conditioned; and (4) a control selectively operating the refrigerant system to move air over the evaporator, and to deliver that air to an outside environment to remove moisture from the evaporator.

19. The method as set forth in claim 18, wherein said fan has a reversible feature, and said control operating said feature to operate said fan in a first direction to move air over the evaporator and then into a space to be conditioned, and operating the said feature to operate said fan in a reverse, second direction, to move the air over the evaporator and to the outside environment.

20. The method as set forth in claim 19, wherein said reversible feature is selected from group consisting of a motor, a switch and a contactor.

21. The method as set forth in claim 18, wherein an airside economizer device controls the mixture of air being delivered to the evaporator between outside air and indoor return air.

22. The method as set forth in claim 21, wherein said airside economizer is operated to block the flow of air back to indoor return duct from said fan when said fan is being operated in said second direction.

23. The method as set forth in claim 21, wherein said return duct is at least partially blocked during the operation of said motor in said second direction.

24. The method as set forth in claim 19, wherein a reheat circuit is incorporated into the refrigerant system, the reheat circuit having a heat exchanger positioned between said fan and said evaporator, and said reheat circuit serving to heat the air being delivered over the evaporator prior to that air reaching the evaporator when the fan is driven in the second direction.

25. The method as set forth in claim 19, wherein said refrigerant system is a heat pump, and said refrigerant system is operated in a heating mode to heat the air being delivered over the evaporator when the fan is driven in the second direction.

26. The method as set forth in claim 19, wherein said refrigerant system is a heat pump, and said refrigerant system is operated in a heating mode with the fan shut down for a short period of time prior to the fan being driven in the second direction.

27. The method as set forth in claim 19, wherein a hot gas bypass to the evaporator inlet is incorporated into the refrigerant system, and said hot gas bypass serving to heat the evaporator when the fan is driven in the second direction.

28. The method as set forth in claim 18, wherein during moisture removal process said fan initially re-circulates air from evaporator to a supply duct, through a bypass duct, to a return duct and back through the evaporator, and then disposes this air to the outdoor environment, and a supply duct being closed to the environment to be conditioned during this operation.

29. The method as set forth in claim 18, wherein during moisture removal process said fan circulates air from evaporator to a supply duct, through a bypass duct, to a return duct, and then disposes this air to the outdoor environment, and a supply duct being closed to the environment to be conditioned during this operation.

30. The method as set forth in claim 18, wherein an exhaust fan assists in moving air to said outside environment.

31. The method as set forth in claim 18, wherein a moisture removal occurs after said refrigerant system is shut down.

32. The method as set forth in claim 18, wherein moisture is removed just prior to the refrigerant system being started.

33. The method as set forth in claim 18, wherein said control is selectively operating based on information obtained from a timer or a sensor.

34. The method as set forth in claim 33, wherein said at least one sensor is selected from a group of a humidity sensor, a dew point sensor, a pressure sensor, a temperature sensor, and an enthalpy sensor.

* * * * *